US006151757A

United States Patent [19]

Beals, Jr. et al.

[11] Patent Number: 6,151,757

[45] Date of Patent: Nov. 28, 2000

[54] LOCKABLE HINGE ASSEMBLY

[75] Inventors: Harry C. Beals, Jr., Jackson; James T. LaGrotta, Boonton; Richard T. LaGrotta, Livingston; Ronald B. Walsh, Jr., Hackettstown, all of N.J.

[73] Assignee: Lucent Technologies Inc., Murray Hill, N.J.

[21] Appl. No.: 09/255,771

[22] Filed: Feb. 23, 1999

[51] Int. Cl.[7] ..... E05D 5/12

[52] U.S. Cl. ..... 16/380; 16/262; 16/265; 16/388

[58] Field of Search ..... 16/265, 268, 262, 16/380, 352, 353, 234, 387, 386, 388, 365

[56] References Cited

U.S. PATENT DOCUMENTS 1,092,926 4/1914 Madsen ..... 16/388
2,748,420 6/1956 Clover ..... 16/273
3,263,269 8/1966 McGahee ..... 16/380
3,805,325 4/1974 Lee ..... 16/262

*Primary Examiner*—Chuck Y. Mah
*Attorney, Agent, or Firm*—David L. Davis

[57] ABSTRACT

A lockable piano-type hinge assembly including a locking hinge piece in addition to two hinge pieces which include the hinge pin barrels. The hinge pin is secured to the locking hinge piece which has an opening aligned with a locking loop secured to one of the hinge pieces. When the hinge assembly is assembled, the locking loop extends through the opening of the locking hinge piece and a locking device is insertable through the locking loop to prevent relative movement of the locking hinge piece and removal of the hinge pin from the barrels.

6 Claims, 3 Drawing Sheets

LOCKABLE HINGE ASSEMBLY

BACKGROUND OF THE INVENTION

This invention relates to a hinge assembly and, more particularly, to a piano-type hinge assembly which is lockable to prevent removal of the hinge pin from the hinge pin barrels and subsequent separation of the hinge pieces and which is also unlockable to allow such removal and separation.

Cabinets holding telecommunications equipment commonly have a door secured to the cabinet frame structure by means of a long continuous piano-type hinge. There are situations when it would be desirable to be able to remove the door for access to the interior of the cabinet, such as when there are space limitations. A piano-type hinge can have a length exceeding two feet and in such cases frictional forces exerted on the hinge pin by the hinge pin barrels make such removal in a field environment difficult. Accordingly, door removal often requires removal of the hardware attaching the hinge to the door or the cabinet. It would therefore be desirable to have a hinge assembly where the hinge pin is more readily removable.

While there are situations where it is desirable to be able to remove the hinge pin, for security purposes to prevent unauthorized access to the cabinet interior it would be desirable to provide a hinge assembly which is lockable.

SUMMARY OF THE INVENTION

According to the present invention, there is provided a lockable hinge assembly for pivotably mounting a first member to a second member. The inventive assembly includes first and second hinge pieces each having a respective hinge pin barrel and each adapted to be mounted to a respective one of the first and second members. A hinge pin having first and second ends is adapted to be inserted into both of the hinge pin barrels when they are stacked and aligned one with the other. A locking loop is secured to one of the first and second hinge pieces and a locking hinge piece is secured to the first end of the hinge pin. The locking hinge piece has an opening for receiving therethrough the locking loop when the hinge pin is inserted into the hinge pin barrels.

In accordance with an aspect of this invention, each of the first and second hinge pieces has an equal number of at least two spaced hinge pin barrels and there are the same equal number of spaced hinge pins secured to the locking hinge piece. The spacing between hinge pin barrels on each of the first and second hinge pieces is such that when respective pairs of hinge pin barrels on the first and second hinge pieces are stacked, the space between each adjacent stacked pair of barrels is sufficient to receive a respective hinge pin aligned for insertion into a respective stacked pair of barrels.

In accordance with another aspect of this invention, the first hinge piece includes a first plate portion adapted to be mounted to the first member and the second hinge piece includes a second plate portion adapted to be mounted to the second member. The hinge pin barrels are formed unitarily with their respective plate portions and the locking loop is secured to one of the first and second plate portions. The locking hinge piece includes a third plate portion having the opening therethrough. A third hinge pin barrel is formed unitarily with the third plate portion and the hinge pin is secured in the third hinge pin barrel. The hinge pin extends sufficiently outwardly from the third hinge pin barrel so as to be insertable into the hinge pin barrels of the first and second plate portions when they are stacked and aligned one with the other.

In accordance with yet another aspect of this invention, the locking loop includes a generally C-shaped member having its ends secured to the one of the first and second plate portions. The locking loop is sized to extend through the third plate portion opening a sufficient distance to form an eye for receiving a locking device.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
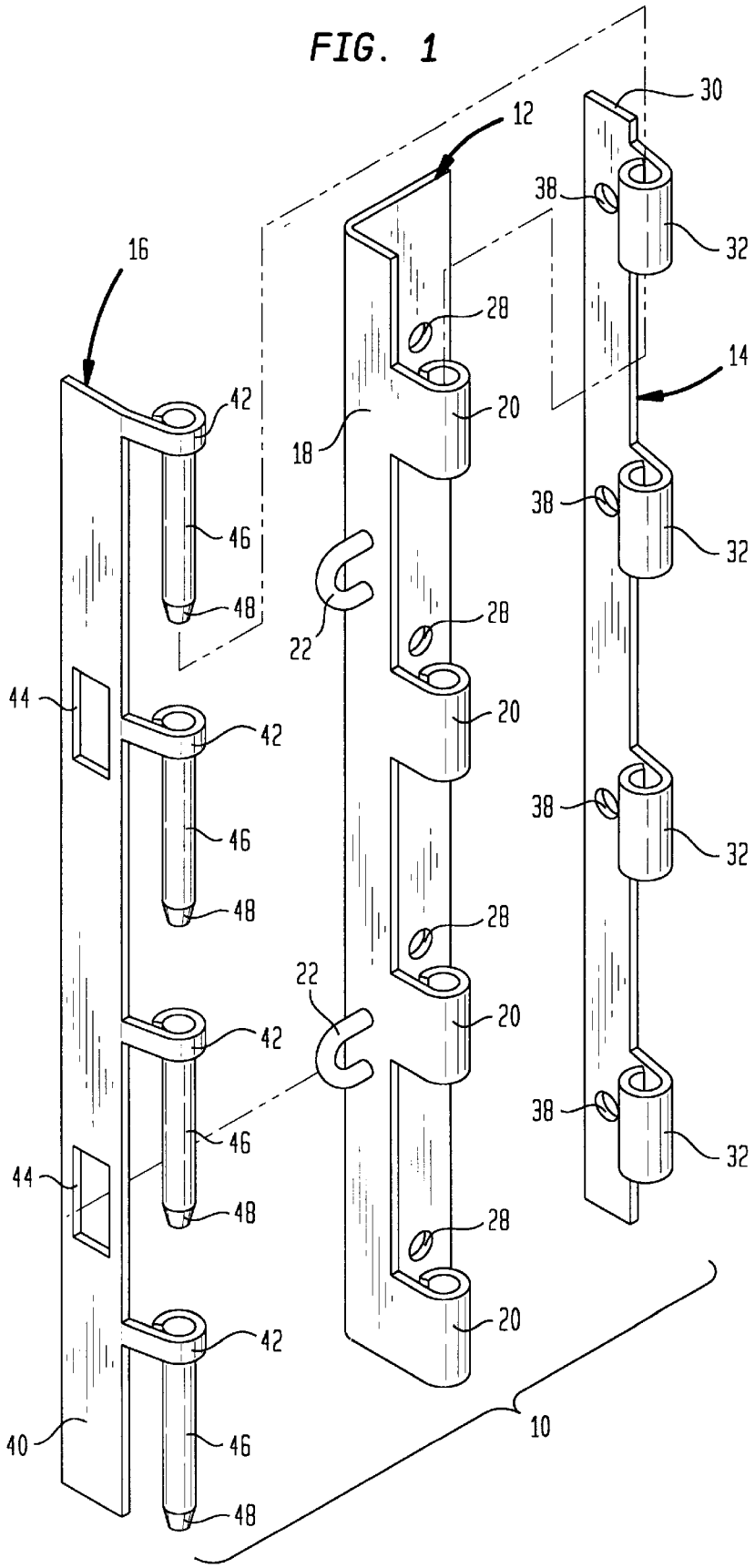
FIG. 1 is an exploded perspective view of an embodiment of a lockable hinge assembly constructed according to the present invention.

Referring now to the drawings, FIG. 1 shows a lockable hinge assembly, designated generally by the reference numeral 10, constructed according to the present invention. As shown, the hinge assembly 10 includes a first hinge piece 12, a second hinge piece 14, and a locking hinge piece 16. The first hinge piece 12 is formed unitarily from sheet stock to have a plate portion 18 bent into an L-shape and a plurality of spaced hinge pin barrels 20. A pair of generally C-shaped locking loops 22 are secured to the plate portion 18, as by welding or the like. The hinge piece 12 is adapted for mounting to the face of cabinet frame structure 24 (FIG. 2), as by screws 26 inserted through openings 28 in the plate portion 18.

Figure 3:
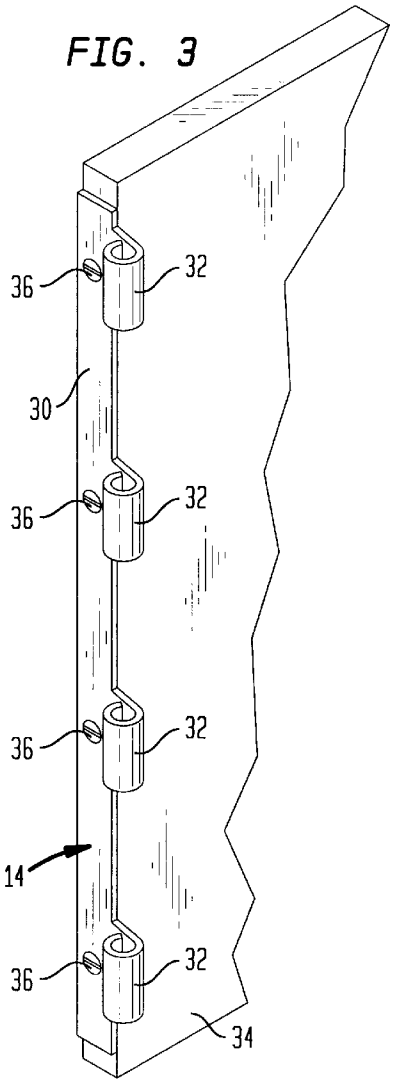
FIG. 3 is a perspective view showing the mounting of the other hinge piece to a cabinet door.

The second hinge piece 14 is similarly formed from sheet stock material to have a plate portion 30 unitary with a plurality of spaced hinge pin barrels 32. The spacing between the barrels 32 is the same as the spacing between the barrels 20 so that the barrels 32 can be stacked atop respective ones of the barrels 20. As shown in FIG. 3, the second hinge piece 14 is adapted for mounting to the edge of a door 34 by screws 36 extending through openings 38 (FIG. 1) in the plate portion 30.

Figure 4:
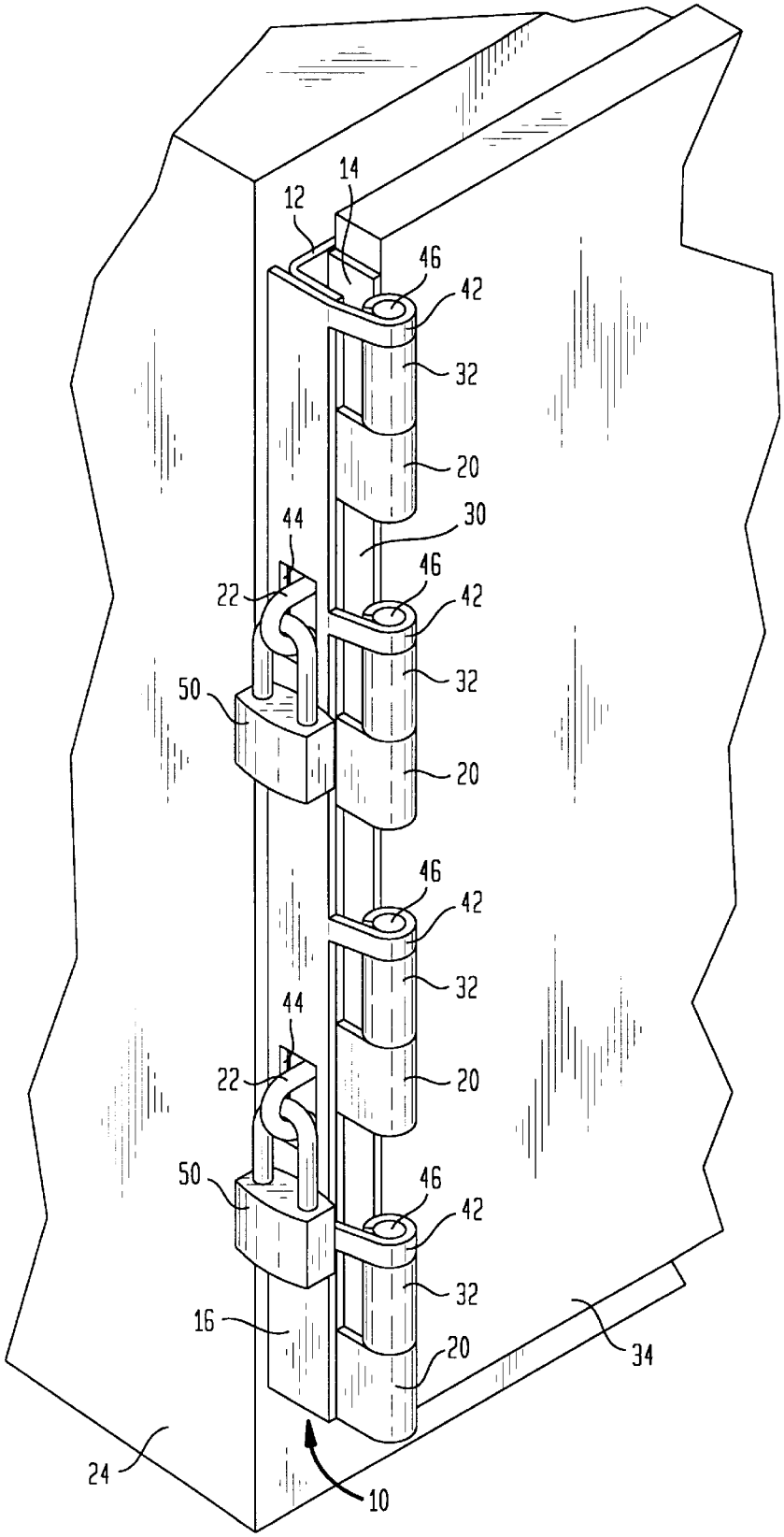
FIG. 4 is a perspective view showing the inventive hinge assembly in a locked condition.

The locking hinge piece 16 is similarly formed unitarily from sheet stock material to have a plate portion 40 and a plurality of spaced hinge pin barrels 42. The spacing between the hinge pin barrels 42 is the same as the spacing between the hinge pin barrels 20 and the spacing between the hinge pin barrels 32, so that the hinge pin barrels 42 can be stacked atop the stacked pairs of hinge pin barrels 32, 20, as shown in FIG. 4. The plate portion 40 is formed with a pair of openings 44. The spacing between the openings 44 is the same as the spacing between the locking loops 22, so that the locking hinge piece 16 can be superposed over the plate portion 18 of the first hinge piece 12 with the locking loops 22 extending through respective ones of the openings 44.

The hinge assembly 10 also includes a plurality of hinge pins 46. The overall length of each hinge pin 46 is substantially equal to the cumulative height of the barrels 20, 32 and 42. Each of the hinge pins 46 is secured at a first end in a respective barrel 42 of the locking hinge piece 16, either by being press fit into the barrel 42 or by having the barrel 42 compressed around the hinge pin 46, or in some other suitable manner. The other end 48 of each hinge pin 46 is chamfered to assist in assembling the hinge.

Figure 2:
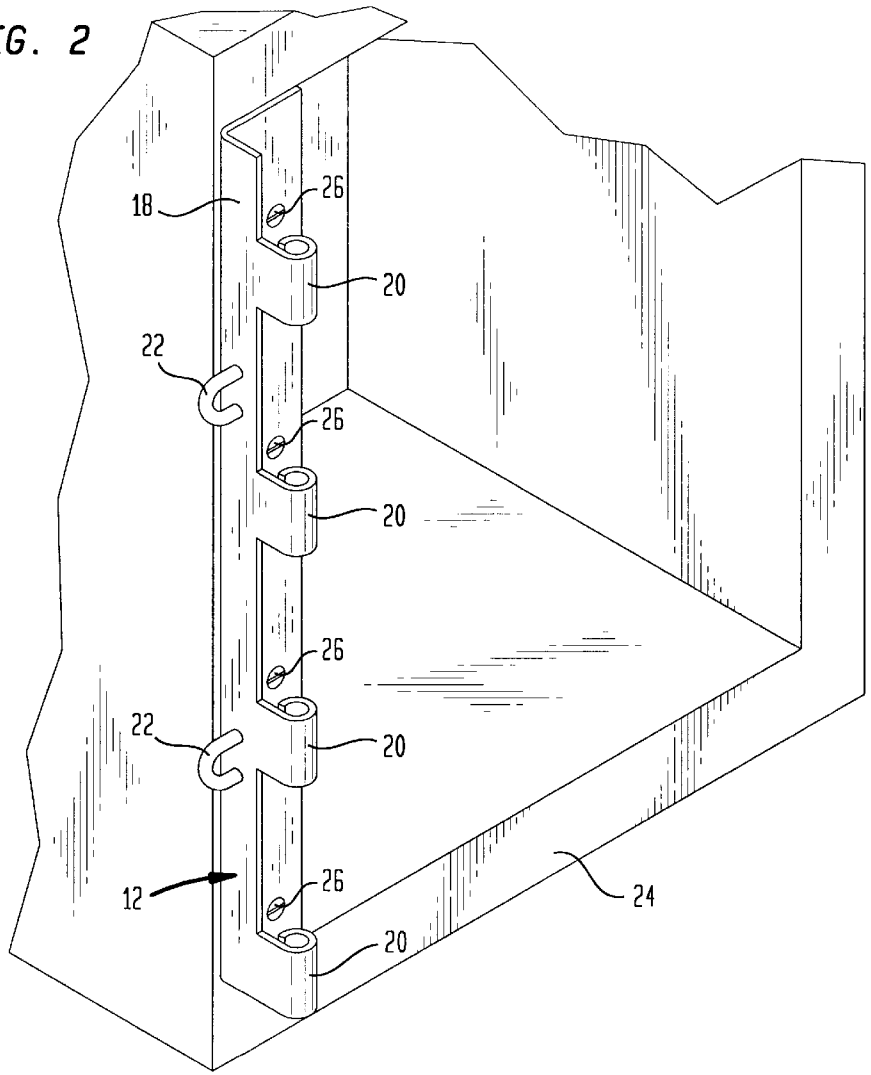
FIG. 2 is a perspective view showing the mounting of one of the hinge pieces to cabinet frame structure.

For assembly, the first hinge piece 12 is secured to the cabinet frame 24, as shown in FIG. 2, and the second hinge piece 14 is secured to the edge of the door 34, as shown in FIG. 3. The door 34 is then positioned adjacent the cabinet frame 24 so that each of the hinge pin barrels 32 is stacked on top and aligned with a respective one of the barrels 20. The internal diameter of each of the barrels 20, 32 is such that the hinge pins 46 fit inside with slight clearance, as is conventional. Next, the locking hinge piece 16 is positioned so that the chamfered second end 48 of each hinge pin 46 is directly above a respective barrel 32. When all of the hinge pins 46 are aligned with their respective barrel pairs 32, 20, the locking hinge piece 16 is moved downwardly so that each hinge pin 46 extends into the interior of a respective stacked pair of barrels 32, 20. The chamfering of the end 48 of the hinge pin 46 makes such insertion easier than if the hinge pin end 48 were not chamfered. The locking hinge piece 16 is then rotated so that the locking loops 22 extend through respective ones of the openings 44. As shown in FIG. 4, the locking loop 22 extends through the opening 44 a sufficient distance to form an eye for receiving a padlock 50 or other suitable locking device.

With one or more padlocks 50 in place, as shown in FIG. 4, the locking hinge piece 16 is fixed relative to the hinge pieces 12, 14, so that the hinge pins 46 cannot be removed from the barrels 32, 20. However, if it is desired to disassemble the hinge assembly 10, the padlock 50 is removed from the locking loop 22, the locking hinge piece 16 is rotated sufficiently that the plate portion 40 is clear of the locking loop 22, and the locking hinge piece 16 is moved upwardly to remove the hinge pins 46 from the barrels 32, 20.

When the barrels 32 are stacked on the barrels 20, the spacing between the lower end of a barrel 20 and the upper end of the next lower barrel 32 must be at least equal to the length of the hinge pin 46 so that there is sufficient room for the hinge pin 46 to be inserted therebetween in alignment with the interior of the barrels 32, 20. If the relative spacings between all of the barrels 42 on the locking hinge piece 16 is equal to the relative spacing between all of the barrels on the first hinge piece 12, which is in turn equal to the relative spacing between all of the barrels 32 on the second hinge piece 14, and if all of the hinge pins 46 extend below the barrels 42 by an equal amount, then the hinge pins 46 will be inserted simultaneously into the barrels 32. However, if desired, the spacings can be changed so that the hinge pin second ends 48 sequentially engage respective barrels 32, 20.

Accordingly, there has been disclosed an improved lockable hinge assembly. While an illustrative embodiment of the present invention has been disclosed herein, it will be apparent to one of skill in the art that various adaptations and modifications to the disclosed construction are possible and it is intended that this invention be limited only by the scope of the appended claims.

What is claimed is:

1. A lockable hinge assembly for pivotably mounting a first member to a second member, comprising:

a first hinge piece having at least one first hinge pin barrel and adapted to be mounted to said first member;

a second hinge piece having at least one second hinge pin barrel and adapted to be mounted to said second member;

at least one hinge pin each having first and second ends and each adapted to be inserted into both of a respective pair of said first and second hinge pin barrels when said first and second hinge pin barrels are stacked and aligned one with the other;

a locking loop secured to one of said first and second hinge pieces; and a locking hinge piece secured to the first end of each of said at least one hinge pin and having an opening for receiving therethrough said locking loop when each of said at least one hinge pin is inserted into the respective pair of said first and second hinge pin barrels;

wherein each of said first and second hinge pieces has an equal number of at least two spaced hinge pin barrels, there are said equal number of spaced hinge pins secured to said locking hinge piece, and the spacing between hinge pin barrels on each of said first and second hinge pieces is such that when respective pairs each consisting of a first hinge pin barrel and a second hinge pin barrel are stacked the space between each adjacent stacked pair of a first hinge pin barrel and a second hinge pin barrel is sufficient to receive a respective hinge pin aligned for insertion into a respective stacked pair of a respective first hinge pin barrel and a respective second hinge pin barrel.

2. The hinge assembly according to claim 1 wherein the second end of said hinge pin is chamfered.

3. The hinge assembly according to claim 1 wherein the hinge pin barrels on each of said first and second hinge pieces are spaced equally to the spacing between hinge pin second ends so that the hinge pin second ends simultaneously engage respective hinge pin barrels.

4. The hinge assembly according to claim 1 wherein the hinge pin barrels on each of said first and second hinge pieces are spaced unequally to the spacing between hinge pin second ends so that the hinge pin second ends sequentially engage respective hinge pin barrels.

5. A lockable hinge assembly for pivotably mounting a first member to a second member, comprising:

a first hinge piece having a first hinge pin barrel and adapted to be mounted to said first member;

a second hinge piece having a second hinge pin barrel and adapted to be mounted to said second member;

a hinge pin having first and second ends and adapted to be inserted into both of said first and second hinge pin barrels when said first and second hinge pin barrels are stacked and aligned one with the other;

a locking loop secured to one of said first and second hinge pieces; and a locking hinge piece secured to the first end of said hinge pin and having an opening for receiving therethrough said locking loop when said hinge pin is inserted into said first and second hinge pin barrels; wherein:

said first hinge piece includes a first plate portion adapted to be mounted to said first member, and said first hinge pin barrel is formed unitarily with said first plate portion;

said second hinge piece includes a second plate portion adapted to be mounted to said second member, and said second hinge pin barrel is formed unitarily with said second plate portion;

said locking loop is secured to one of said first and second plate portions; and said locking hinge piece includes a third plate portion having said opening therethrough, and a third hinge pin barrel formed unitarily with said third plate portion, said hinge pin being secured in said third hinge pin barrel and extending sufficiently outwardly therefrom to be insertable into said first and second hinge pin barrels when stacked and aligned one with the other.

6. The hinge assembly according to claim 5 wherein:

said locking loop includes a generally C-shaped member having its ends secured to said one of said first and second plate portions and being sized to extend through said third plate portion opening a sufficient distance to form an eye for receiving a locking device.

* * * * *